US008641327B2

(12) United States Patent
Krehbiel et al.

(10) Patent No.: US 8,641,327 B2
(45) Date of Patent: Feb. 4, 2014

(54) METHODS AND APPARATUS FOR PROTECTING OFFSHORE STRUCTURES

(75) Inventors: Drew Krehbiel, Richmond, TX (US); Richard D'Souza, Houston, TX (US)

(73) Assignee: Kellogg Brown & Root LLC, Houston, TX (US)

( * ) Notice: Subject to any disclaimer, the term of this patent is extended or adjusted under 35 U.S.C. 154(b) by 1012 days.

(21) Appl. No.: 11/830,078

(22) Filed: Jul. 30, 2007

(65) Prior Publication Data

US 2009/0035069 A1 Feb. 5, 2009

(51) Int. Cl.
*E02B 15/02* (2006.01)
*B63B 35/08* (2006.01)

(52) U.S. Cl.
USPC ..... 405/216; 405/61; 405/217

(58) Field of Classification Search
USPC ..... 405/211–217, 61; 114/40–42, 219
See application file for complete search history.

(56) References Cited

U.S. PATENT DOCUMENTS 3,807,179 A * 4/1974 Stone ..... 405/61
4,038,830 A * 8/1977 Sumner ..... 405/208
4,063,428 A * 12/1977 Waas ..... 405/212
4,102,144 A * 7/1978 Anders ..... 405/211
4,103,504 A 8/1978 Ehrlich
4,242,012 A 12/1980 Utt
4,468,152 A * 8/1984 Lamy et al. ..... 405/61
4,504,172 A 3/1985 Clinton et al.
4,512,684 A 4/1985 Hale et al.
4,523,879 A 6/1985 Finucane et al.
4,657,116 A * 4/1987 Gardner et al. ..... 187/401
4,784,526 A 11/1988 Turner
5,292,207 A 3/1994 Scott
6,371,695 B1 4/2002 Davenport, III et al.
6,955,503 B1 10/2005 Shivers, III et al.

OTHER PUBLICATIONS

Definition of the word "fixed" according to Merriam-Webster's Collegiate Dictionary Tenth Edition, published 1993, p. 441.*

* cited by examiner

*Primary Examiner* — Sunil Singh
(74) *Attorney, Agent, or Firm* — Gary M. Machetta

(57) ABSTRACT

Protective structures for offshore installations and methods for using same are provided. The protective structure can include a body adapted to be disposed at least partially about a primary structure of an offshore installation, and a support system can be disposed on the body. One or more protrusions can be disposed about an outer surface of the body. The protrusions can have a first end adapted to break ice. The support system can be adapted to isolate the one or more bodies from the primary structure such that the one or more bodies can absorb at least a portion of ice generated vibrations.

30 Claims, 6 Drawing Sheets

METHODS AND APPARATUS FOR PROTECTING OFFSHORE STRUCTURES

CROSS-REFERENCE TO RELATED APPLICATIONS

1. Field

The present embodiments generally relate to offshore installations. More particularly, present embodiments relate to methods and apparatus for protecting offshore structures from ice generated vibrations.

2. Background

A typical offshore installation or platform has two main components, the substructure and the superstructure. The superstructure, also referred to as the topsides, is supported on a deck which is fixed on the substructure ("primary structure"). The primary structure can be a steel or concrete substructure. Most fixed offshore oil and gas production platforms have a steel tubular substructure, although certain platforms have a gravity concrete substructure.

Most platforms are uniquely designed for the particular reservoir condition, location, water depth, soil characteristics, wind, wave and marine current conditions in which the platforms operate. For example, the steel and concrete primary structures of fixed platforms can be built in water depths from a few meters to more than 300 meters.

Exploration and production of hydrocarbon reserves in arctic and sub-arctic offshore regions present unique challenges due to ice. Vibration due to ice loads can be a constant threat to the primary structures of fixed platforms. Thus, fixed platforms are rarely, if ever, used in sub-arctic or arctic waters. There is a need, therefore, to address the afore-mentioned problems.

BRIEF DESCRIPTION OF THE DRAWINGS

So that the manner in which the above recited features of the present embodiments can be understood in detail, a more particular description of the invention, briefly summarized above, may be had by reference to embodiments, some of which are illustrated in the appended drawings. The appended drawings illustrate only typical embodiments and are therefore not to be considered limiting of its scope, for the inventions herein may admit to other equally effective embodiments.

The present embodiments are detailed below with reference to the listed Figures.

DETAILED DESCRIPTION OF THE EMBODIMENTS

A detailed description will now be provided. Each of the appended claims defines a separate invention, which for infringement purposes is recognized as including equivalents to the various elements or limitations specified in the claims. Depending on the context, all references below to the "invention" may in some cases refer to certain specific embodiments only. In other cases it will be recognized that references to the "invention" will refer to subject matter recited in one or more, but not necessarily all, of the claims. Each of the inventions will now be described in greater detail below, including specific embodiments, versions and examples, but the inventions are not limited to these embodiments, versions or examples, which are included to enable a person having ordinary skill in the art to make and use the inventions, when the information in this patent is combined with available information and technology.

Methods and apparatus for protecting offshore installations from ice generated vibrations are provided. In one or more embodiments, a protective structure can be disposed at least partially about a primary structure of an offshore installation. One or more protrusions can be disposed about an outer surface of the protective structure. One or more support systems can be disposed on the protective structure. The support system can be adapted to support the protective structure independently of the primary structure. As such, the protective structure can absorb at least some of the ice generated vibrations the primary structure might experience at sea if the protective structure were not used.

In at least one specific embodiment, the protective structure includes a body adapted to be disposed at least partially about a primary structure of an offshore installation. One or more protrusions can be disposed about an outer surface of the body, wherein the protrusions have a first end adapted to break ice. A support system can be disposed on the body adapted to isolate the body from the primary structure such that the body can absorb at least a portion of ice generated vibrations. The body can be one unit or a plurality of individual units ("plurality of bodies").

Figure 1:
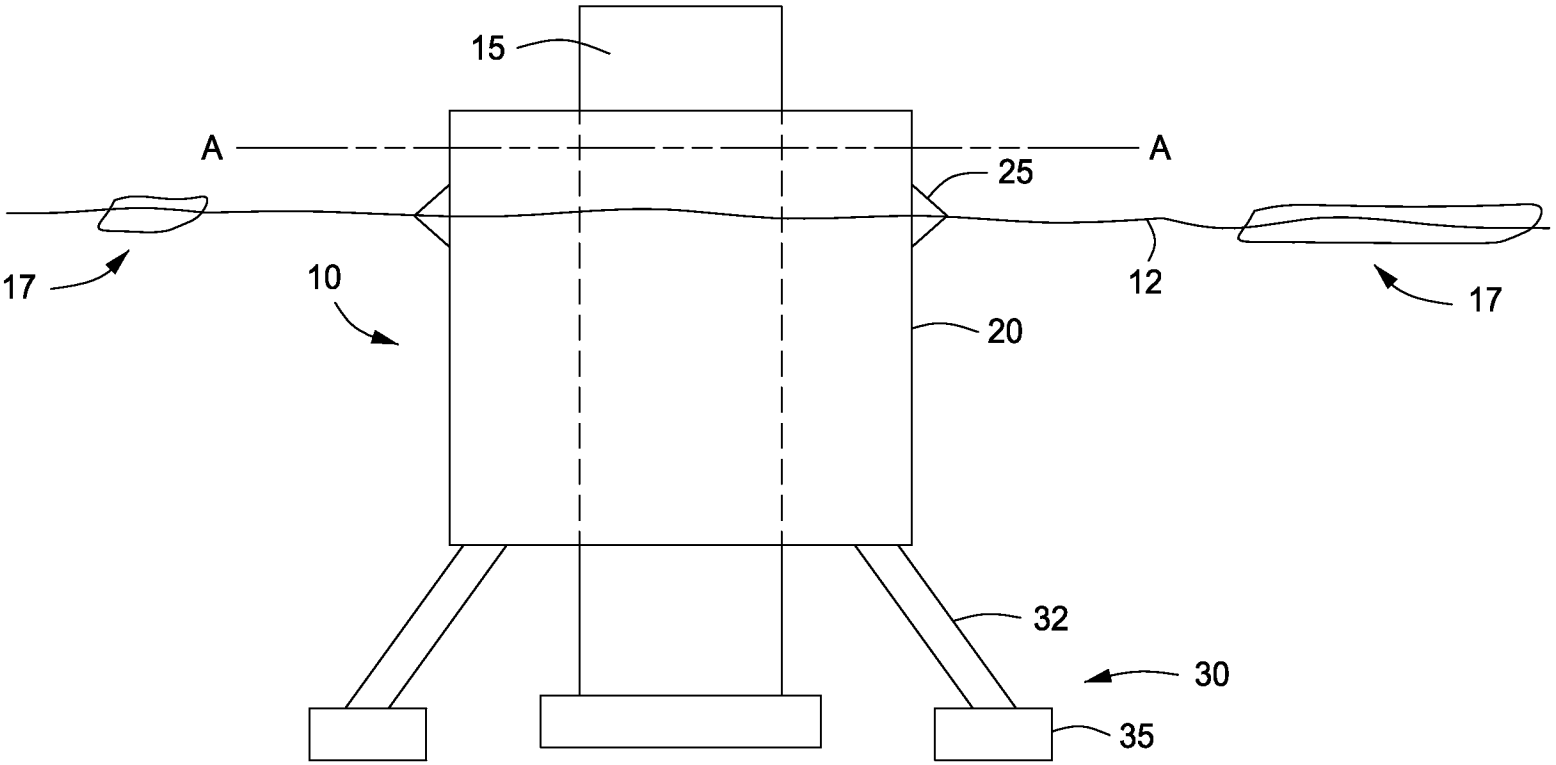
FIG. 1 depicts an illustrative primary structure of an offshore installation having a protective structure, according to one or more embodiments described.

With reference to the figures, FIG. 1 depicts an illustrative primary structure 15 of an offshore installation having a protective structure, according to one or more embodiments described. The primary structure 15 can be any type of substructure, including a single or multi-leg steel substructure or concrete substructure. The primary structure 15 can be any shape or size.

In one or more embodiments, the primary structure 15 can include a protective structure 10 at least partially disposed thereabout. The protective structure 10 can absorb at least a portion of the ice generated vibrations that can be generated by sheet ice and/or flowing ice 17 in the water. The protective structure 10 can include a body 20, one or more protrusions ("ice cones") 25, and one or more support systems 30. The body 20 can be disposed at least partially about the primary structure 15. The support system 30 can be adapted to support the body 20 independently of the primary structure 15.

The body 20 can be adapted to absorb ice generated vibration. In one or more embodiments, the body 20 can be a perimeter structure or shield about the primary structure 15.

In one or more embodiments, the body 20 can be disposed at least partially about the primary structure 15 to fully shield or at least partially shield the primary structure 15 from at least a portion of the ice generated vibrations that the primary structure 15 would experience if the body 20 were not disposed about the primary structure 15. In one or more embodiments, the body 20 can be disposed completely around the primary structure 15 to fully shield or at least partially shield the primary structure 15 from ice generated vibrations.

In one or more embodiments, the protective structure 10 can include a plurality of bodies 20. Each body 20 of the protective structure 10 can be adapted to be at least partially disposed about the primary structure 15. In one or more embodiments, the plurality of bodies 20 can be adapted to be disposed at least partially about the primary structure such that the combination of the plurality of bodies can surround the primary structure. In one or more embodiments, at least two bodies 20 can be adapted to be disposed about a separate portion of the primary structure 15. Two or more bodies 20 of the protective structure 10 can move independently of each other. In one or more embodiments, one or more bodies 20 can move independently of the protective structure 10. In one or more embodiments, the protective structure 10 can have two or more bodies 20, each capable of independent motion with respect to the other bodies 20 and with respect to the primary structure 15. In one or more embodiments, each body 20 can have a different shape and/or size than another. One or more bodies 20 can be shaped to match a portion of the primary structure 15 depending on the portion of the primary structure 15 about which the body 20 is disposed The body 20 can have any thickness sufficient to absorb ice generated vibrations. The body 20 can be made from any material or combination of materials suitable to absorb ice generated vibrations. For example, the body 20 can be made from carbon steel, stainless steel, nickel, aluminum, blends thereof and alloys thereof.

In one or more embodiments, the body 20 can have one or more passive or active systems (not shown) to allow the body 20 to absorb or dissipate ice generated vibrations. For example, an active system can sense vibrations within the body 20 and generate a damping force that at least partially dissipates or counteracts the sensed vibrations. In one or more embodiments, the body 20 can have an interior void (not shown). In one or more embodiments, the interior void of the body 20 can be at least partially filled with energy dissipating material. For example, the body 20 can be at least partially filled with a porous material or other energy absorbing materials that can absorb or dissipate ice generated vibrations.

In one or more embodiments, the body 20 can be supported by support legs 32 that can dissipate or absorb vibrations by directing the vibrations through the support legs 32 to the sea floor. In one or more embodiments, the body 20 can have a visco-elastic coating adapted to absorb vibrations. In one or more embodiments, the body 20 can have a tuned mass damper adapted to dissipate vibrations. In one or more embodiments, the body 20 can have at least one active system and at least one passive system to allow the body 20 to absorb or dissipate ice generated vibrations. The body 20 can have an active or passive system disposed on any surface of the body 20. In one or more embodiments, the body 20 can have an active or passive system attached thereto.

In one or more embodiments, at least one active system and at least one passive system can be disposed on the protective structure 10 to allow the protective structure 10 to absorb or dissipate ice generated vibrations. In one or more embodiments, the protective structure 10 can have at least one active system or at least one passive system to allow the protective structure 10 to absorb or dissipate ice generated vibrations.

In one or more embodiments, the protective structure 10 can be fabricated on shore, transported to the site of the offshore installation and installed about the primary structure 15. For example, the protective structure 10 can be fabricated on shore, transported on a barge to the installation site, and installed about the primary structure 15 using cranes. In one or more embodiments, the protective structure 10 can be fabricated in one or more modular sections on shore, transported to the installation site, assembled, and installed about the primary structure 15. The protective structure 10 can be installed one modular section at a time and welded or otherwise assembled together by underwater divers. In one or more embodiments, support ships can be used to tow modular sections of the protective structure 10 to the installation site. In one or more embodiments, floatation devices can be used to transport modular sections of the protective structure 10 to the installation site. In one or more embodiments, support ships and/or floatation devices can be used to transport the protective structure 10 to the installation site. In one or more embodiments, support ships and/or floatation devices can be used during the installation process of the protective structure 10. In one or more embodiments, the protective structure 10 can be fabricated in situ using methods and apparatus known in the art.

The protective structure 10 can be used with any type of primary structure 15 of an offshore installation. In one or more embodiments, the primary structure 15 can be a steel substructure. In one or more embodiments, the primary structure 15 can be a gravity concrete substructure. The primary structure 15 of the offshore installation can have one or more support members (i.e. "legs"). For example, the primary structure 15 can have a single-leg or multi-leg configuration. Illustrative offshore installations can include fixed or gravity supported offshore drilling rigs, semi-submersibles, jack-up rigs, and production platforms.

In one or more embodiments, at least a portion of the body 20 can be located at or near the water surface 12. In one or more embodiments, a portion of the body 20 can be under the water surface 12 and a portion of the body 20 can be above the water surface 12. For example, 10%, 20%, 30%, 40%, or 50% of the body 20 can be below the water surface 12 and the balance above. In one or more embodiments, 5%, 15%, 25%, 35%, 45% or 55% of the body 20 can be above the water surface 12 and the balance below. Since the height of the water surface 12 can change, and thus the ice level, with respect to the primary structure 15 or protective structure 10, the location of the body 20 with respect to the water surface 12 can also change. For example, the height of the water surface 12 can change with the tides. In one or more embodiments, the body 20 can be any size or shape suitable to withstand fluctuations in the height of the water surface (and ice) 12 while maintaining at least some protection for the primary structure 15 against ice generated vibrations.

The one or more support systems 30 can be disposed on the body 20 and can be adapted to support the body 20 independently of the primary structure 15. The support system 30 can include one or more support legs 32. Each support leg 32 can be fixed to the sea bed by gravity or otherwise anchored to the sea bed. For example, one or more anchoring devices 35 can be used to fix the support leg 32 to the sea bed. The anchoring devices 35 can include one or more mud mats, piles, piles guides, or any combinations thereof. In one or more embodiments, the support legs 32 can be any height to allow at least a portion of the body 20 to be situated at or near the water surface 12.

In one or more embodiments, the body 20 can be adapted to impinge upon and/or break the surrounding ice 17 into smaller formations so as to impose less force against the body 20. For example, the body 20 can have a sloped surface (not shown) to deflect the surrounding ice 17 in an upward or downward direction that can cause a bending stress on the ice 17. The resulting bending stresses imposed on the ice 17 can cause the ice 17 to break into smaller ice 17 pieces.

In one or more embodiments, the body 20 can be adapted to allow watercraft to gain access to the offshore installation. For example, the body 20 can be adapted to rise above or below the water surface 12 to allow one or more watercraft, not shown, to gain access to the offshore installation. For example, the lowering or raising of at least a portion of the body 20 can be effected or facilitated by the use of cranes, lifts, elevators, and/or support ships. In one or more embodiments, at least a portion of the body 20 can be lowered below the water surface 12 such that the one or more watercraft can pass over the lowered portion of the body 20. At least a portion of the body 20 can be adapted to be raised above the water surface 12 to allow for the passage of the one or more watercraft to gain access to the offshore installation. In one or more embodiments, at least a portion of the body 20 can be temporarily removed to allow for the passage of the one or more watercraft to gain access to the offshore installation.

In one or more embodiments, the body 20 can be adapted to allow watercraft to pass through the body 20 to gain access to the offshore installation. For example, the body 20 can have a throughway or opening through which one or more watercraft can pass. In one or more embodiments, the body 20 can have an articulating or sliding panel, door, or wall that can be moved to create a temporary throughway in the body 20 to allow one or more watercraft to gain access to the offshore installation.

In one or more embodiments, the body 20 can include one or more protrusions 25. In one or more embodiments, the protrusions 25 can be adapted to break the ice 17. The one or more protrusions 25 can have a sloped end or angled edge to help break the ice 17 into smaller pieces or formations. The protrusions 25 can be an extruded portion of the body 20. The protrusions 25 can be welded or otherwise fixed to the outer surface of the body 20. The one or more protrusions 25 can be any shape or size and made from any suitable material to deflect or break the surrounding ice 17. For example, the protrusions 25 can be made from carbon steel, stainless steel, nickel, aluminum, blends thereof and alloys thereof.

Figure 2:
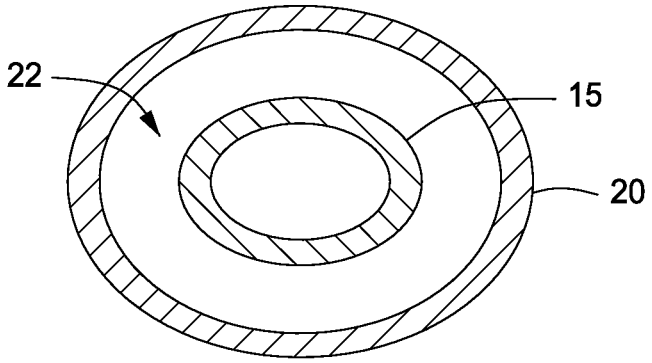
FIG. 2 depicts a cross sectional view along line A-A of one or more embodiments of FIG. 1, according to one or more embodiments described.

FIG. 2 depicts a cross sectional view along line A-A of one or more embodiments of FIG. 1, according to one or more embodiments described. A cavity or space 22 can be defined between the primary structure 15 and the body 20. The space 22 can allow the body 20 to vibrate or move independently of the primary structure 15. In those cases where the cavity or space is filled with water, either an active or passive ice removal system can be employed to keep the space clear of ice buildup. For example, a waste heat system can be used to keep the water in space 22 at a temperature above freezing.

In one or more embodiments, the shape of body 20 can approximate the shape of the primary structure 15 and maintain the space 22 disposed therebetween. For example, the body 20 can be shaped to resemble a rectangular, tubular, annular, circular, or conical structure, depending on the shape and size of the primary structure 15. In one or more embodiments, the body 20 can be any shape or size and can be adapted to be disposed about at least a portion of the primary structure 15. The space 22 can be any shape or size defined by the shapes and sizes of the primary structure 15 and the body 20. The space 22 can allow the body 20 to vibrate due to contact with the surrounding ice without contacting the primary structure 15. The space 22 can allow the body 20 to act as a damper between the ice generated vibrations and the primary structure 15 such that some portion of the ice generated vibrations can be absorbed by the body 20.

In one or more embodiments, two or more bodies 20 can be adapted to be disposed at least partially about the primary structure 15, each body 20 having a different shape and/or size than another depending on the portion of the primary structure 15 about which the body 20 is disposed while maintaining the space 22 disposed therebetween. For example, a first body 20 having an annular shape can be disposed at least partially about an annular portion of the primary structure 15 while a second body 20 having a conical shape can be disposed at least partially about a conical portion of the primary structure 15.

In one or more embodiments, two or more bodies 20 can be welded or otherwise fitted together to be disposed at least partially about or completely around the primary structure 15 while maintaining the space 22 disposed therebetween. For example, two bodies 20 that are half-moon shaped can be used. Likewise, three or more bodies 20 can be used in proximity to each other to make up a perimeter or at least a partial shield about the primary structure 15. Each body 20 can be equally spaced and/or sized to fit at least partially about the primary structure 15 and maintain the space 22 disposed therebetween. Each body 20 can be shaped, spaced, and/or sized differently from every other body 20.

The one or more support systems 30 can be adapted to support the body 20 independently of the primary structure 15 such that the space 22 can be maintained between the primary structure 15 and the body 20. The one or more support systems 30 can be made from any suitable material to prevent the body 20 from contacting the primary structure 15. For example, one or more support systems 30 can be made from carbon steel, stainless steel, nickel, aluminum, blends thereof and alloys thereof.

Figure 3:
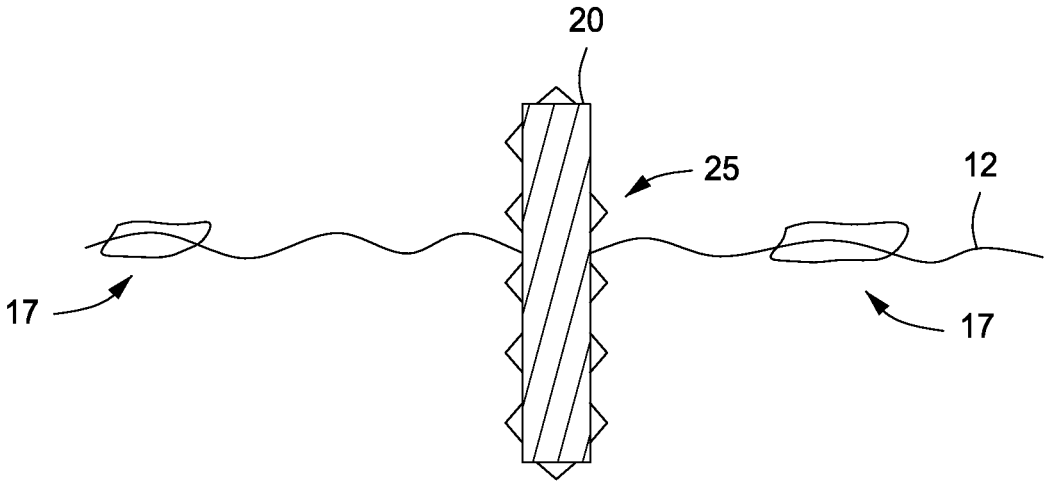
FIG. 3 depicts an illustrative section view of a body having one or more ice impinging protrusions disposed thereon.

FIG. 3 depicts an illustrative section view of a body having one or more ice impinging protrusions disposed thereon. In one or more embodiments, each ice impinging or ice breaking protrusion 25 can be disposed on any location of the outer surface of the body 20. For example, the protrusions 25 can be situated about the outer surface of the body 20 such that the protrusions 25 are at or near the water surface 12. For example, one or more protrusions 25 can be located above the water surface 12, and one or more protrusions 25 can be located below the water surface 12. Having the protrusions 25 at or near the water surface 12 can facilitate the deflecting and/or breaking of any ice 17 that might contact the body 20. For example, an ice sheet contacting the body 20 can encounter one or more protrusions 25 at different locations relative to the water surface 12. The one or more protrusions 25 can deflect the ice sheet in one or more directions such that a torsional or bending stress can be imposed on the ice sheet making contact with the one or more protrusions 25 and can cause the ice sheet to break. Breaking portions of the ice sheet formed about the body 20 can reduce the amount of ice generated vibrations experienced by the body 20.

Figure 4:
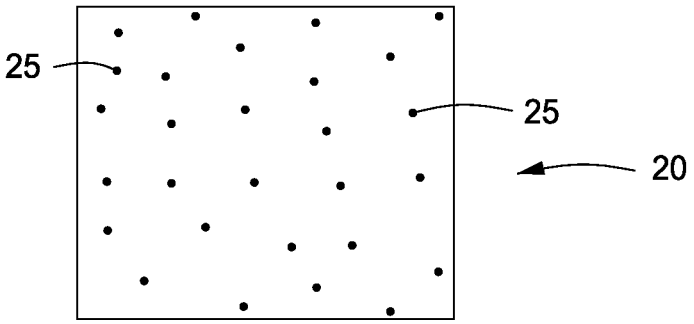
FIG. 4 depicts a partial view of an outer surface of a body according to one or more embodiments described.

FIG. 4 depicts a partial view of an outer surface of a body according to one or more embodiments described. In one or more embodiments, the protrusions 25 can be randomly disposed about the body 20. In one or more embodiments, the protrusions 25 can be disposed about the body 20 using any pattern. For example, the protrusions 25 can be arranged in groups of two or more. The groups can be equally distributed about the body 20. In one or more embodiments, the protrusions 25 can be arranged in a sinusoidal pattern about the body 20. In one or more embodiments, the protrusions 25 can be arranged in a zigzag pattern about the body 20. In at least one specific embodiment, the protrusions 25 can be arranged in two or more rows equidistant from one another about the body 20.

Figure 5:
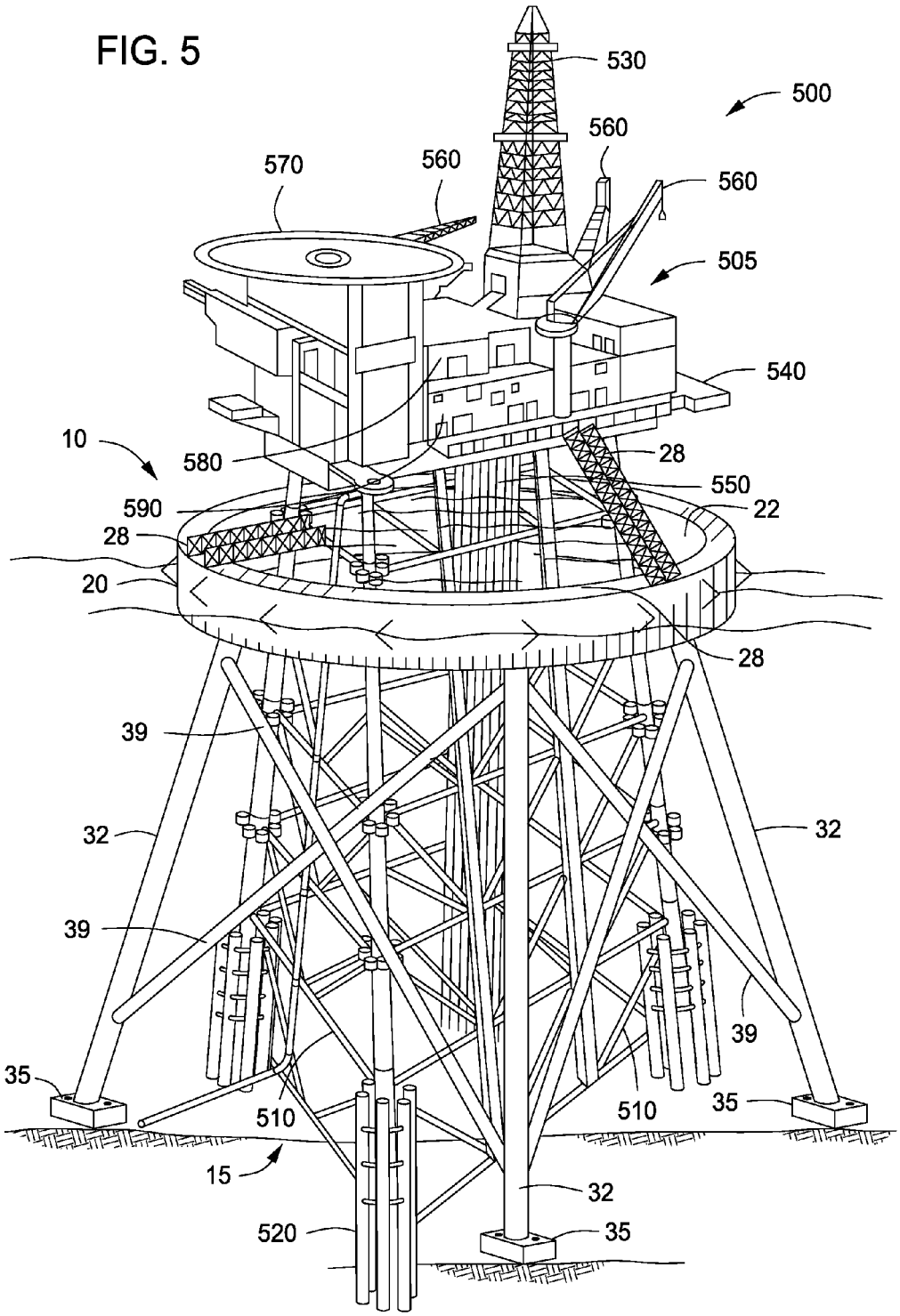
FIG. 5 depicts an illustrative offshore installation having a multi-leg primary structure and a protective structure, according to one or more embodiments described.

FIG. 5 depicts an illustrative offshore installation having a multi-leg primary structure and a protective structure, according to one or more embodiments described. The offshore installation 500 can have a superstructure 505 having any number of drilling, operating, and processing equipment disposed thereon. Drilling, operating, and processing equipment are known in the art and can include, for example, a drilling derrick 530, a drilling deck 540, drill strings 550, one or more cranes 560, a heliport 570, operation management facilities 580, and personnel housing 590. The primary structure 15 of the offshore installation 500 can be a four-leg steel jacket with lattice stabilizers 510 and pile guides 520.

As depicted in FIG. 5, the body 20 can be adapted to be disposed about the primary structure 15. The body 20 can be supported independently of the primary structure 15 by the one or more support legs 32. One or more lateral members 39 can be disposed between any two or more support legs 32 to further strengthen the support legs 32. Having the one or more lateral members disposed between any two or more support legs 32 can prevent the protective structure 10 from contacting the primary structure 15.

The body 20 can have an annular shape and an inner diameter sufficiently large to be disposed at least partially about the primary structure 15. The space 22 can allow the body 20 to move independently of the primary structure 15 due to ice generated vibrations without transmitting the vibrations to the primary structure 15. In one or more embodiments, the body 20 can be annular having a thickness sufficient to allow the body 20 to absorb ice generated vibrations without contacting the primary structure 15. In one ore more embodiments, the body 20 can have a thickness sufficient to take a direct impact from surrounding ice.

As depicted in FIG. 5, a connecting structure 28 can be disposed between the offshore installation 500 and the body 20. In one or more embodiments, the connecting structure 28 can be disposed between the primary structure 15 and the body 20. The connecting structure 28 can be adapted to allow for the passage of personnel and/or items including drilling, production, and offloading equipment between the offshore installation 500 and the one or more bodies 20. In one or more embodiments, the connecting structure 28 can be used for the transportation of items associated with offshore drilling, production, and operations. The connecting structure 28 can be used in lieu of or in combination with watercraft to gain access to the offshore installation 500. In one or more embodiments, the connecting structure 28 can be used in lieu of or in combination with watercraft to gain access to the primary structure 15.

The connecting structure 28 can include a fixed bridge, free floating bridge, draw bridge, and/or unloading deck. In one or more embodiments, the connecting structure 28 can be adapted to be permanently disposed between the offshore installation 500 and the body 20. In one or more embodiments, the connecting structure 28 can be disposed between the offshore installation 500 and the body 20 when needed for delivery or receipt of personnel or items between the offshore installation 500 and watercraft. In one or more embodiments, the connecting structure 28 can be a modular structure. For example, the connecting structure 28 can be towed to the installation site in modular sections, assembled, and disposed between the offshore installation and the body 20.

Figure 6:
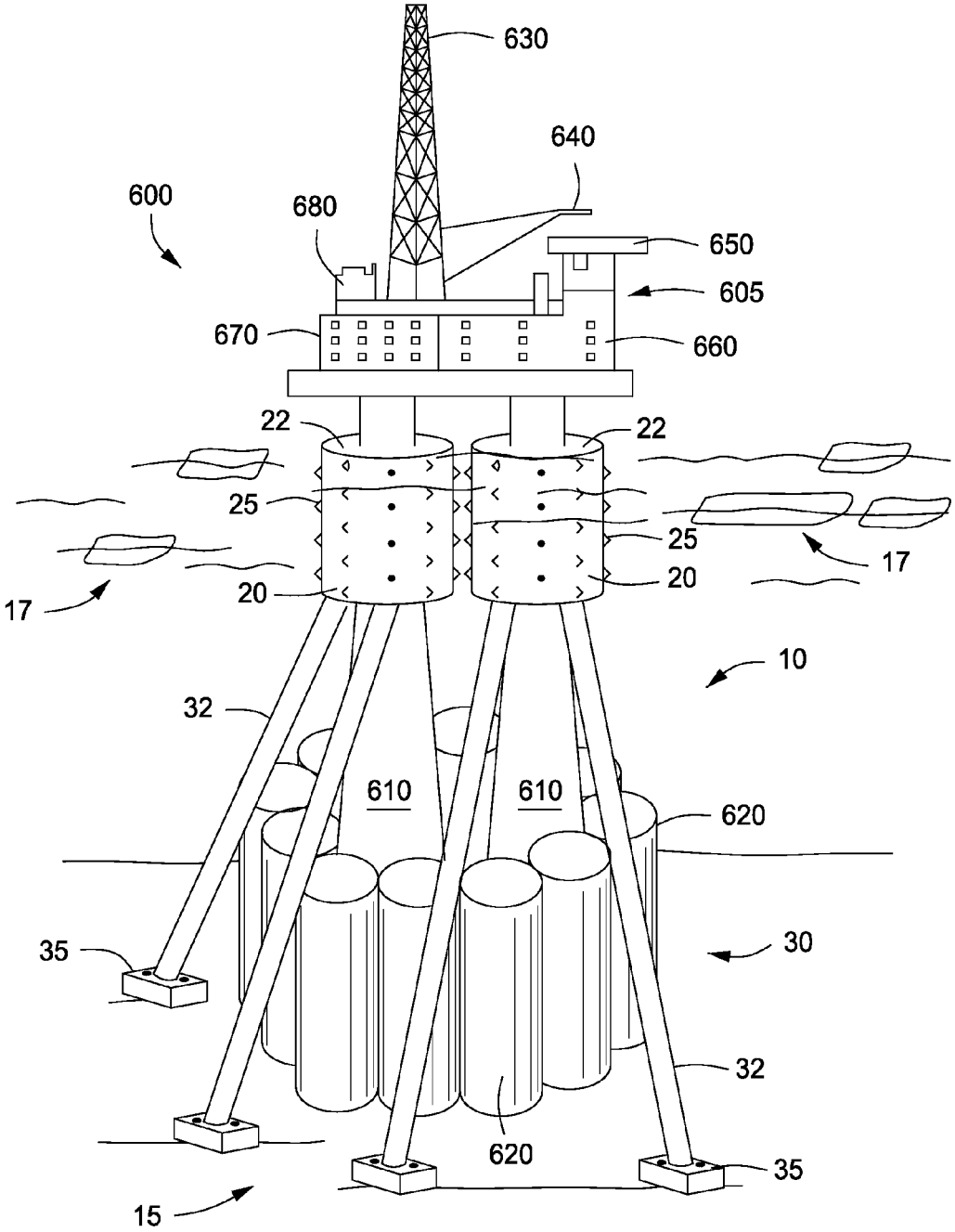
FIG. 6 depicts an illustrative offshore installation having a two-leg primary structure and a protective structure, according to one or more embodiments described.

FIG. 6 depicts an illustrative offshore installation having a two-leg primary structure and a protective structure, according to one or more embodiments described. The offshore installation 600 can have a superstructure 605 having any number of drilling, operating, and processing equipment disposed thereon. Drilling, operating and processing equipment are known in the art and can include, for example, a drilling derrick 630, a crane 640, a heliport 650, personnel housing 660, an operations management facility 670, and a mud circulating system 680. The primary structure 15 of the offshore installation 600 can be a two-leg gravity concrete substructure having two concrete towers 610 surrounded by interconnected concrete cylinders 620. The primary structure 15 can be fixed to the sea bed by gravity.

In one or more embodiments, each body 20 can be adapted to be disposed at least partially about a separate portion of the primary structure 15. As depicted, each body 20 can be adapted to be disposed at least partially about a separate leg 610 of the primary structure 15. In one or more embodiments, three bodies 20 can each be adapted to be disposed at least partially about a separate leg of a three-leg primary structure 15. In one or more embodiments, four bodies 20 can each be adapted to be disposed at least partially about a separate leg of a four-leg primary structure 15.

In one or more embodiments, each body 20 can be supported independently of the support leg 610 by the one or more support legs 32. One support system 30 including three support legs 32 and three anchoring devices 35 can support each protective structure 10 independently of the support leg 610. The anchoring device 35 can include a mud mat and two piles. In one or more embodiments, the anchoring device 35 can help support the support leg 32. In one or more embodiments, the anchoring device 35 can prevent or minimize movement in the support leg 32.

One or more bodies 20 can have a tubular shape and an inner diameter sufficiently large to be disposed at least partially about the leg 610 while maintaining a space 22 disposed therebetween. The space 22 can allow the body 20 to move due to ice generated vibrations without contacting the leg 610. The space 22 can allow the body 20 to move due to ice generated vibrations without transmitting the vibrations to the leg 610. In one or more embodiments, the body 20 can be tubular having a thickness sufficient to allow the body 20 to absorb ice generated vibrations without contacting the leg 610.

Figure 7:
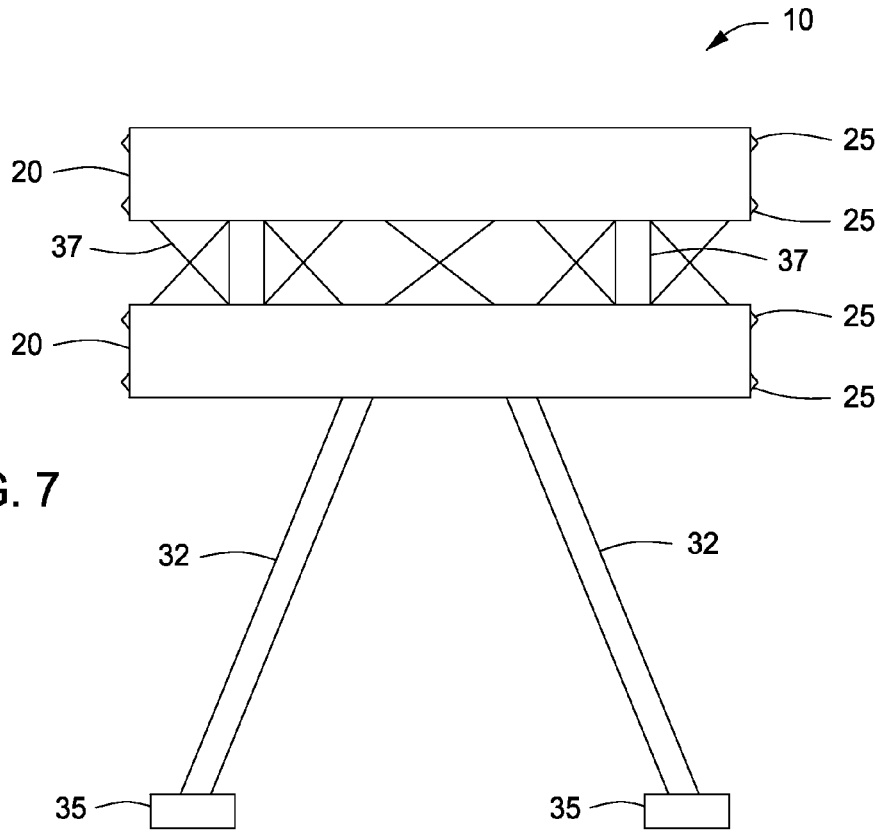
FIG. 7 depicts a schematic of an illustrative protective structure according to one or more embodiments described.

FIG. 7 depicts a schematic of an illustrative protective structure according to one or more embodiments described. In one or more embodiments, two or more bodies 20 can be disposed vertically relative to one another. In one or more embodiments, the two or more bodies 20 can be vertically disposed relative to each other such that there can be a vertical distance between the two or more bodies 20. In one or more embodiments, the vertical distance between the two or more bodies 20 can reduce the wave load on the protective structure 10. The wave load on an object can be a function of the area upon which the force (wave load) acts. Having a larger vertical distance between the two or more bodies 20 can reduce the cumulative surface area of the two or more bodies 20 and can allow the waves to flow between the two or more bodies 20, thereby reducing the wave load on the protective structure 10

In one or more embodiments, the protective structure 10 can include one or more intermediate structural members 37 disposed between any two bodies 20. In one or more embodiments, the intermediate structural members 37 can be adapted to absorb the ice generated vibrations in place of the primary structure 15. The one or more intermediate structural members 37 can be configured to prevent the passage of ice 17 therethrough. In one or more embodiments, the one or more intermediate structural members 37 disposed between any two bodies 20 can minimize the size of the ice 17 passing therethrough, thereby minimizing the ice load on the primary structure 15. Such a configuration of the protective structure 10 can provide an economic benefit since less material can be used to construct the bodies 20 yet the protective structure 10 can still provide protection to the primary structure 15 from ice generated vibrations.

The one or more intermediate structural members 37 can be shaped differently from one another. In one or more embodiments, the one or more intermediate structural members 37 can have any shape and/or size. In one or more embodiments, the one or more intermediate structural members 37 can have any shape and/or size to prevent the passage of ice 17 therethrough. The one or more intermediate structural members 37 can be made from any suitable material and can be any size or shape such that the intermediate structural members 37 can absorb ice generated vibrations.

Figure 8:
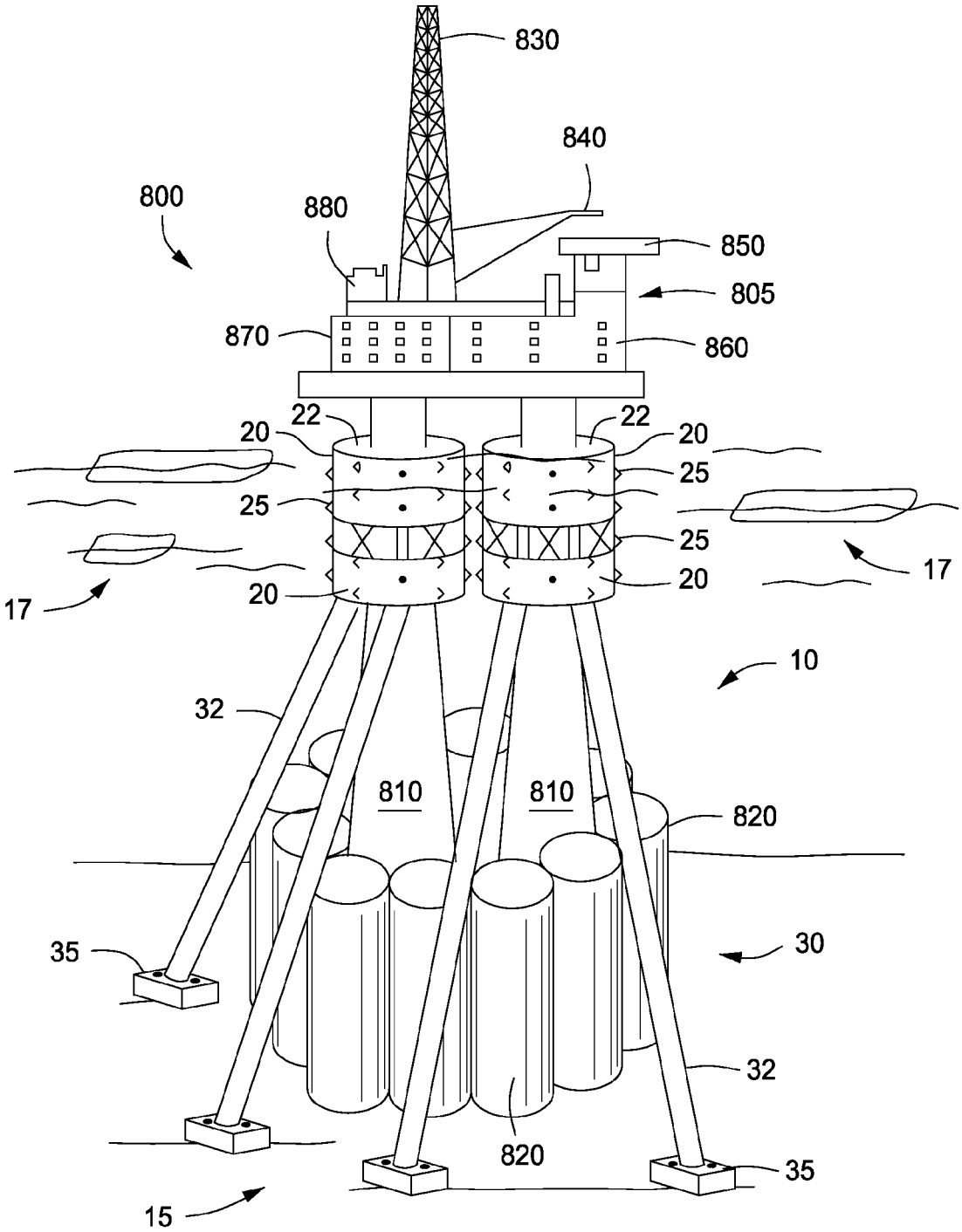
FIG. 8 depicts an illustrative two-leg primary structure of an offshore installation according to one or more embodiments described.

FIG. 8 depicts an illustrative two-leg primary structure 15 of an offshore installation 800 according to one or more embodiments described. The offshore installation 800 can have a superstructure 805 having any number of drilling, operating, and processing equipment disposed thereon. Drilling, operating and processing equipment are well known in the art and can include, for example, a drilling derrick 830, a crane 840, a heliport 850, personnel housing 860, an operations management facility 870, and a mud circulating system 880. The primary structure 15 of the offshore installation 800 can be a two-leg gravity concrete substructure having two concrete towers 810 surrounded by interconnected concrete cylinders 820. The primary structure 15 can be fixed to the sea bed by gravity.

In one or more embodiments, a protective structure 10 having two or more bodies 20 can be disposed at least partially about each leg of a multi-leg primary structure 15. As depicted, two bodies 20 can each be adapted to be disposed at least partially about a separate leg 810 of the primary structure 15. Each protective structure 10 can include two bodies 20. In one or more embodiments, each body 20 of the protective structure 10 can be adapted to be disposed at least partially about a separate portion of the primary structure 15. In one or more embodiments, the protective structure 10 can have two or more bodies 20 vertically disposed relative to one another. In one or more embodiments, the protective structure 10 can have two or more bodies 20 vertically disposed relative to one another having a vertical distance therebetween. In one or more embodiments, one or more intermediate support members 37 can be disposed between any two bodies 20 of a protective structure 10.

In one or more embodiments, three or more protective structures 10 each having two or more bodies 20 can each be disposed at least partially about each leg of a three-leg primary structure 15. In one or more embodiments, four or more protective structures 10 each having two or more bodies 20 can each be disposed at least partially about each leg of a four leg primary structure 15.

Each body 20 can have a tubular shape and an inner diameter sufficiently large to be disposed at least partially about the leg 810 while maintaining a space 22 disposed therebetween. The space 22 can allow the body 20 to move due to ice generated vibrations without contacting the leg 810. In one or more embodiments, the body 20 can be tubular having a thickness sufficient to allow the body 20 to absorb ice generated vibrations without contacting the leg 810. In one or more embodiments, the body 20 can be tubular having a height sufficiently high to help prevent ice from contacting the leg 810.

Figure 9:
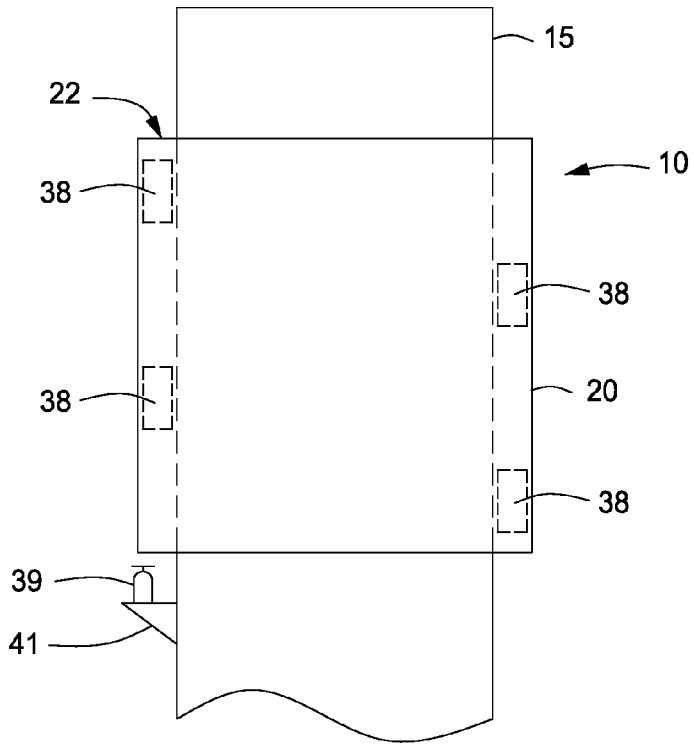
FIG. 9 depicts an illustrative protective structure disposed on a primary structure according to one or more embodiments described.

FIG. 9 depicts an illustrative protective structure disposed on a primary structure according to one or more embodiments described. In one or more embodiments, the protective structure 10 can include one or more vibration supports 38. The one or more vibration supports 38 can be adapted to absorb or dissipate ice generated vibrations. In one or more embodiments, the primary structure 15 can support the body 20 using the one or more vibration supports 38. For example, the vibration supports 38 can be isolators such as wire rope isolators or any other isolators. Wire rope isolators can be helical wound cable isolation mounts that can offer multi-axis shock and vibration isolation. One or more examples of commercially available isolators include isolators offered by Enidine Incorporated.

In one or more embodiments, the vibration supports 38 can be distributed around the primary structure 15. The one or more vibration supports 38 can be disposed between the primary structure 15 and the body 20. Two or more vibration supports 38 can be disposed at the same location between the primary structure 15 and the body 20. For example, two or more vibration supports 38 can be secured to each other in series and the combination can be disposed at one location between the primary structure 15 and the body 20. The one or more vibration supports 38 can work in concert at one or more locations around the primary structure 15 to isolate the primary structure 15 from the body 20.

In one or more embodiments, the body 20 can be supported by one or more protrusions 41. The protrusions 41 can be disposed on the primary structure 15 such that the body 20 can rest on the one or more protrusions 41. In one or more embodiments, the body 20 can be isolated from the primary structure 15 by one or more snubbers and/or isolators 39 disposed between the one or more protrusions 41 and the body 20. In one or more embodiments the one or more isolators 39 are similar to or identical to the one or more vibration supports 38.

In one or more embodiments, the one or more vibration supports 38 can be disposed between the primary structure 15 and the body 20 in the space 22. In one or more embodiments, the one or more vibration supports 38 can be adapted to absorb vibrations imparted on the body 20 during various weather conditions, including ice generated vibrations. In one or more embodiments, the one or more vibration supports 38 can have a damping coefficient sufficient to dissipate ice generated vibrations. The one or more vibration supports 38 can support the body 20 on the primary structure 15 and can at least one of the vibration supports 38 can be a cylinder and piston combination adapted to absorb vibrations imparted on the body 20 during various weather conditions, including ice generated vibrations.

Certain embodiments and features have been described using a set of numerical upper limits and a set of numerical lower limits. It should be appreciated that ranges from any lower limit to any upper limit can be contemplated unless otherwise indicated. Certain lower limits, upper limits and ranges appear in one or more claims below. All numerical values can be "about" or "approximately" the indicated value, and take into account experimental error and variations that would be expected by a person having ordinary skill in the art.

Various terms have been defined above. To the extent a term used in a claim is not defined above, it should be given the broadest definition persons in the pertinent art have given that term as reflected in at least one printed publication or issued patent. Furthermore, all patents, test procedures, and other documents cited in this application are fully incorporated by reference to the extent such disclosure is not inconsistent with this application and for all jurisdictions in which such incorporation is permitted.

While the foregoing is directed to embodiments of the present invention, other and further embodiments of the invention can be devised without departing from the basic scope thereof, and the scope thereof is determined by the claims that follow.

What is claimed is:

1. A structure for an offshore installation, comprising:

two or more bodies adapted to be disposed at least partially about a primary structure of an offshore installation, wherein the bodies are vertically-offset from one another;

one or more protrusions disposed about an outer surface of each body, wherein each protrusion has a first end adapted to break ice, and wherein each protrusion is not moveable relative to the bodies; and a support system disposed on at least one of the bodies, the support system adapted to isolate the bodies from the primary structure such that the bodies can absorb at least a portion of ice generated vibrations.

2. The structure of claim 1, wherein the bodies are adapted to surround the primary structure.

3. The structure of claim 1, wherein at least two of the bodies are each adapted to be disposed at least partially about a separate portion of the primary structure.

4. The structure of claim 1, wherein the support system comprises one or more isolators disposed between the bodies and the primary structure.

5. The structure of claim 1, wherein the support system is adapted to support the bodies independently of the primary structure.

6. The structure of claim 5, wherein the support system comprises one or more support legs adapted to provide an upward force on the bodies.

7. The structure of claim 1, wherein each protrusion is welded to one of the bodies.

8. The structure of claim 1, wherein each protrusion is welded or otherwise fixed to one of the bodies.

9. The structure of claim 1, wherein the one or more protrusions comprises a plurality of protrusions.

10. The structure of claim 9, wherein the protrusions are arranged in groups of two or more.

11. The structure of claim 10, wherein the groups are equally distributed about the bodies.

12. The structure of claim 9, wherein the protrusions are randomly disposed about the bodies.

13. The structure of claim 9, wherein the protrusions are arranged in a sinusoidal pattern about at least one of the bodies.

14. The structure of claim 9, wherein the protrusions are arranged in a zig zag pattern about at least one of the bodies.

15. The structure of claim 9, wherein the protrusions are arranged in two or more rows equidistant from one another about at least one of the bodies.

16. The structure of claim 1, wherein the bodies comprise an interior void, and wherein the interior void is at least partially filled with an, energy dissipating material.

17. The structure of claim 1, wherein the outer surface of east one of the bodies is cylindrically shaped.

18. The structure of claim 1, further comprising one or more support members disposed between and coupled to the bodies.

19. A method for absorbing ice generated vibrations in place of a primary structure of an offshore installation, comprising:

disposing a protective structure at least partially about a portion of the primary structure, wherein the protective structure comprises two or more bodies that are vertically-offset from one another, each body having one or more protrusions disposed about an outer surface thereof, wherein each protrusion is adapted to break ice, and wherein each protrusion is not moveable relative to the bodies; and supporting the bodies with one or more support systems, wherein the support system is disposed on at least one of the bodies, and wherein the support system is adapted to isolate the bodies from the primary structure such that the bodies can absorb at least a portion of ice generated vibrations.

20. The method of claim 19, wherein the bodies are disposed at least partially about the primary structure.

21. The method of claim 20, further comprising disposing the bodies about the primary structure such that the bodies surround the primary structure.

22. The method of claim 19, further comprising disposing the bodies at least partially about a separate portion of the primary structure.

23. The method of claim 19, wherein the one or more support systems comprises one or more isolators disposed between the bodies and the primary structure.

24. The method of claim 19, wherein the one or more support systems comprises one more support legs that support the bodies independently of the primary structure and provide an upward force on the bodies.

25. An offshore installation, comprising:

a primary structure supporting a superstructure;

two or more bodies disposed at least partially about the primary structure, wherein the bodies are vertically-offset from one another, each body comprising one or more protrusions having a first end adapted to break ice disposed about an outer surface thereof, and wherein each protrusion is not moveable relative to the bodies; and one or more support systems adapted to isolate the bodies from the primary structure such that the bodies can absorb at least a portion of ice generated vibrations.

26. The offshore installation of claim 25, wherein at least two of the bodies are each adapted to be disposed at least partially about a separate portion of the primary structure.

27. The offshore installation of claim 25, wherein the bodies are adapted to surround the primary structure.

28. The offshore installation of claim 25, wherein the one or more support systems comprises one or more isolators disposed between the primary structure and the bodies.

29. The offshore installation of claim 25, wherein the one or more support systems comprises one or more support legs that support the bodies independently of the primary structure and provide an upward force on the bodies.

30. A protective structure for an offshore installation, comprising:

two or more bodies adapted to be disposed a least partially about a prima structure of an offshore installation, wherein the bodies are vertically-offset from one another;

one or more fixed protrusions disposed about an outer surface of each body, wherein each fixed protrusion has a first end adapted to break ice, and wherein each fixed protrusion is non-movable relative to the bodies; and one or more support systems disposed on at least one of the bodies, wherein the support system is adapted to isolate each body from the primary structure such that the bodies can absorb at least a portion of ice generated vibrations.

* * * * *